United States Patent [19]

McNamara

[11] 4,289,197

[45] Sep. 15, 1981

[54] HEAT EXCHANGER

[76] Inventor: Thomas J. McNamara, 1384 Brown St., Des Plaines, Ill. 60016

[21] Appl. No.: 19,758

[22] Filed: Mar. 12, 1979

[51] Int. Cl.[3] ..... F28D 3/04

[52] U.S. Cl. ..... 165/115; 165/174

[58] Field of Search ..... 165/154, 155, 174, 115–117; 62/516–518, 347

[56] References Cited

U.S. PATENT DOCUMENTS

| | | | |
|---|---|---|---|
| 1,993,390 | 3/1935 | Voss | 165/115 |
| 2,062,321 | 12/1936 | Levin | 165/159 |
| 3,202,210 | 8/1965 | Hughes | 165/154 |
| 3,213,935 | 10/1965 | Reid, Jr. | 165/117 |
| 3,473,348 | 10/1969 | Bottum | 165/154 |

*Primary Examiner*—Samuel Scott
*Assistant Examiner*—Theophil W. Streule, Jr.
*Attorney, Agent, or Firm*—Wegner, Stellman, McCord, Wood & Dalton

[57] ABSTRACT

A heat exchanger having a horizontally-disposed, elongate shell with a partition extending lengthwise of the shell and interiorly thereof to form upper and lower compartments therein. The shell has end closures with at least one end closure having a flow passage communicating with the lower compartment of the shell for flow of fluid therethrough. A fluid port communicates with the upper compartment for delivering fluid thereto and passages at the edges of said upper compartment permit fluid flow from the upper compartment along the length thereof to wet the interior of the shell wall in the lower compartment. Fluid conduit means is positioned on the exterior of the shell for substantially the entire length thereof to place fluid in the conduit means in heat exchange relation with said shell wall.

14 Claims, 5 Drawing Figures

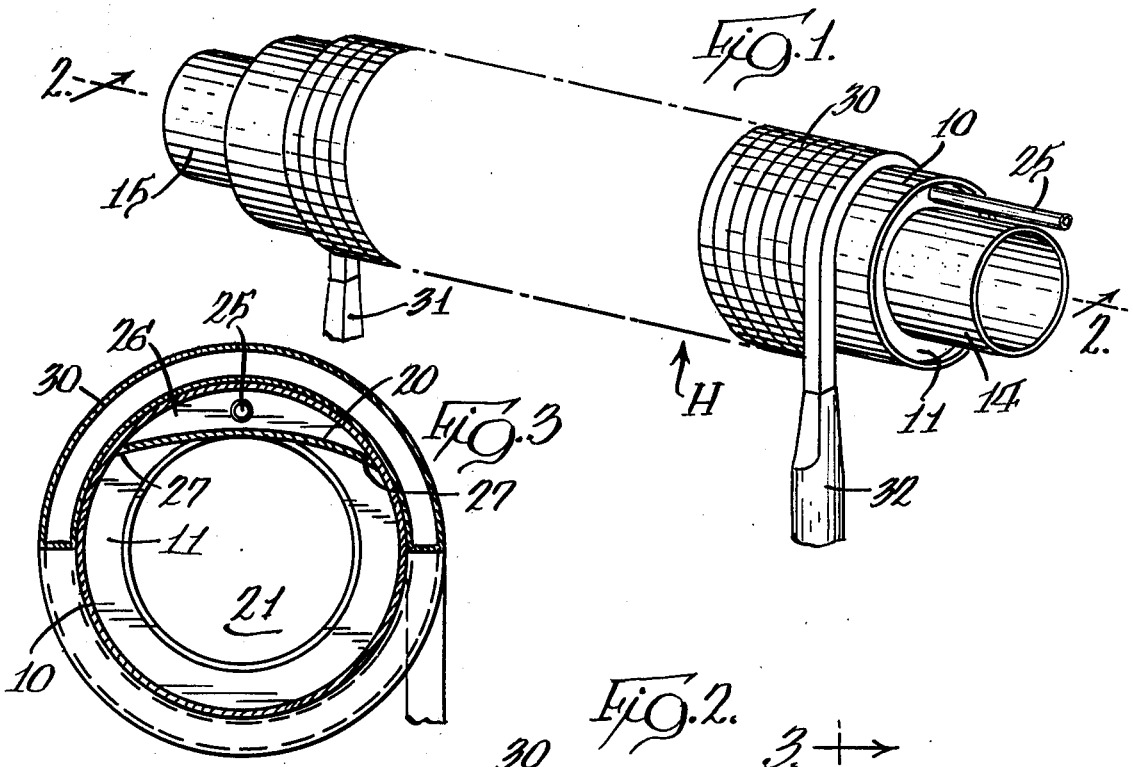
Fig. 1.
2
15
31
30
10
25
H
11
14
2
32
25
26
30
20
27
27
11
21
10
Fig. 3
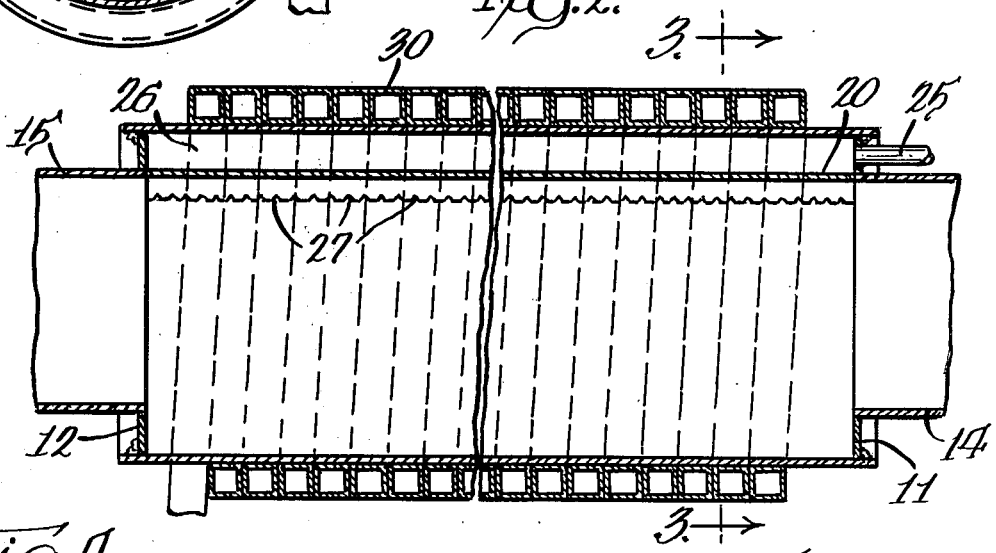
Fig. 2.
3
30
26
20
25
15
27
12
14
11
3
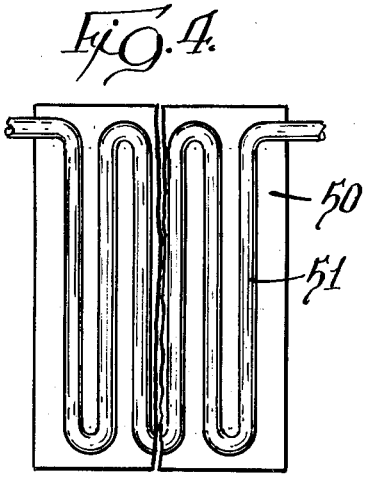
Fig. 4.
50
51
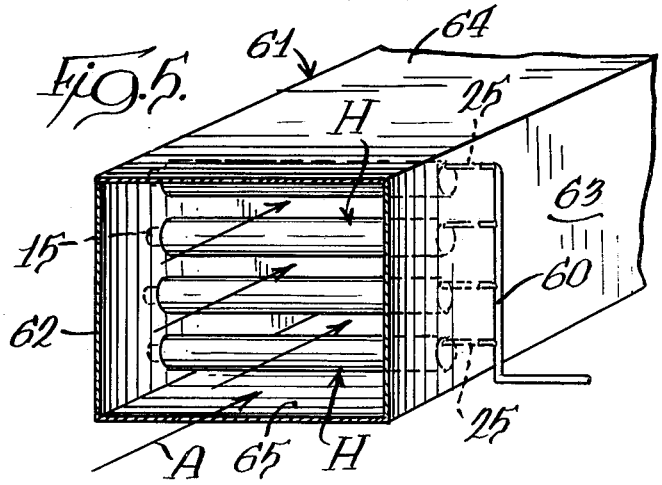
Fig. 5.
61
64
25
H
63
15
60
62
25
A
65
H

HEAT EXCHANGER

BACKGROUND OF THE INVENTION

This invention pertains to heat exchangers and other forms of energy recovery apparatus, such as a chiller, wherein a low-cost unit formed of relatively simple components maximizes the saving of energy in both the manufacture thereof as well as in use thereof.

Many different devices are known for obtaining heat exchange between a pair of fluids including units in which one fluid is caused to flow along the wall of a shell and another fluid is brought into heat exchange relation with the shell. One example of such structure is shown in Burdick U.S. Pat. No. 1,694,370 wherein a series of vertical tubes have one fluid flowing along the interior of the tube wall and another fluid flowing vertically downward along the outer surface of the wall. This device has many structural and operational disadvantages. It is expensive to construct with the requirement for a main enclosure for the system and has many sealing surfaces to maintain the separation of fluid spaces. Additionally, the parallel flow of the fluids does not provide as high efficiency of heat exchange as can be obtained by means of a cross-flow or counter-flow of fluids.

The Dawson U.S. Pat. No. 3,502,140 shows a heat exchanger for two liquids having a relatively complex structure for obtaining a falling film of liquid and additionally requiring a primary enclosure for the structure.

A primary feature of the invention disclosed herein is to provide a heat exchanger having a simple circuit in which fluids are maintained separate and in confined paths with savings in energy in manufacture of the heat exchanger as well as utilization thereof and with low-cost construction and operation and with the capability of handling a plurality of separate fluids.

More particularly, the heat exchanger has a basic shell to receive fluid and surrounding fluid passages which may be of simple construction and in heat exchange relation with the shell. The unit may be insulated simply by applying insulation to the exterior of the surrounding fluid passages thereby essentially eliminating heat losses when adequate insulating material is applied. The cost to insulate is minimal because of the simple, regular, small surface area to be insulated and the heat exchange efficiency is maximized.

More particularly, the shell can be a tubular member, such as standard pipe or tubing of a size required for the particular operation, and the fluid in heat exchange relation with the pipe can be conducted through preformed fluid channels which are closely fitted about the pipe and with optionally usable heat transfer promotion medium therebetween, such as a silicone or grease with aluminum oxides which are commercially available. A simply constructed partition member is inserted within the pipe to provide upper and lower compartments and a fluid connection delivers fluid to the upper compartment. Passage means provided along the edges of the partition member permit flow of fluid from the upper compartment into the lower compartment by flowing along the interior of the shell wall. The partition member may be formed of a longitudinal section of a pipe of greater diameter and formed with notches along its opposite edges and then fitted into the shell to provide the upper and lower compartments.

With the structure disclosed herein, the heat exchange can be for either heating or cooling of a medium, either within the shell or within the fluid containment means disposed therearound.

The heat exchanger has high heat exchange efficiency because of combined counterflowing and cross-flowing action of the respective fluids. With the flow of fluid down the shell wall along the entire length thereof, the temperature within the shell is capable of being maintained uniform which results in minimum time for cooling of fluid in the surrounding fluid containment means for equivalent heat exchange boundary area in other types of heat exchanger, all other factors being equal.

A primary application of the heat exchanger is in use thereof as a chiller as usable in an absorption refrigeration and air conditioning system, as shown in my prior U.S. Pat. No. 3,661,200, dated May 9, 1972. In the water chiller disclosed therein, liquid ammonia and helium gas are delivered to the chiller and are caused to chill a liquid, such as ethylene glycol/water, a typical anti-freeze solution, for use in the air conditioning system.

In the chiller, the liquid ammonia evaporates and combines with a warmer helium gas delivered to one end of the chiller and the combined cold vapors of ammonia mixed with the helium pass from an opposite end of the chiller. Use of the construction disclosed herein results in a highly efficient energy saving unit with low pressure losses throughout the unit. The higher refrigerant pressures that exist in the system are contained within the shell and, therefore, the conduit means containing the liquid (ethylene-glycol solution) to be cooled need not have substantial structural strength. With the horizontal disposition of the structure, the unit can handle three fluids, with two fluids within the shell actually passing in opposite directions therein.

The disclosed heat exchanger has utility in many different systems. As an example, several of the heat exchange units can be arranged in one or more horizontally-spaced rows and in horizontal positions and with units positioned one directly above another in a row. The vertical space between units in a row would be approximately one-half the diameter of a shell. Liquid refrigerant is introduced into the upper compartment of each horizontal unit. The refrigerant flows horizontally the length of the shell upper compartment and flows down the interior of the shell wall in the lower compartment, as earlier described for the chiller application. The refrigerant is evaporated from the entire length of the lower compartment by exchange of heat through the shell wall from a warmer fluid flowing normal to the longitudinal axes of the horizontally-disposed heat exchanger units. This flow is through a formed contained fluid path, such as a duct, the boundaries of which are the ends of the horizontal lengths of the heat exchanger units and the vertical distance from the bottom of the lowermost heat exchange unit to the top of the uppermost unit. Because of the higher efficiency of the heat exchange units disclosed herein, it is possible to use a minimal number of rows of units for a typical air conditioning application in which the refrigerant is evaporated within the lower compartments of the shells by exchange of heat from the warmer fluid (air) flowing normal to the longitudinal axes of the heat exchange units.

BRIEF DESCRIPTION OF THE DRAWING

FIG. 1 is a perspective view of the heat exchanger;

FIG. 2 is a vertical section on an enlarged scale with parts broken away, taken generally along the line 2—2 in FIG. 1;

FIG. 3 is a vertical section, on a further enlarged scale, taken generally along the line 3—3 in FIG. 2;

FIG. 4 is a fragmentary plan view of an alternate form of commercially-available formed plate tube-forming fluid conduit means; and FIG. 5 is a perspective view of part of an air conditioning system using the heat exchanger.

DESCRIPTION OF THE PREFERRED EMBODIMENT

The heat exchanger H is shown generally in FIG. 1 wherein a shell 10, formed suitably from a length of standard pipe or tubing, has a pair of end closures 11 and 12 fitted and secured one in each end thereof and each having a central opening and a tubular member 14 and 15 extending therefrom, respectively, providing for flow passages communicating with a lower compartment within the shell 10. A partition member 20 extends lengthwise of the shell to provide a lower compartment 21 and an upper compartment 26 within the shell and with the lower compartment having the major part of the volume. The size of the shell is chosen to provide a volume which will receive a desired flow of liquid or gas and permit change of state thereof. As an example, the pipe defining the shell 10 could be chosen to have a diameter of four inches and, in such example, the partition member 20 can be formed of a longitudinal section of a larger diameter pipe, such as a six inch pipe, and then inserted lengthwise within the shell and secured to the interior of the shell wall before fitting of the end closures 11 and 12.

A fluid port 25 communicates with the upper chamber 26 above the partition member to deliver fluid into the upper compartment. This fluid is then caused to flow down along the entire interior of the shell wall for the entire length of the shell by means in the form of notches or passages 27 along each of the edges of the partition member and which form flow passages permitting gravity flow of fluid downwardly into the lower compartment.

The fluid within the lower compartment of the shell may leave through the opening in either of the end closures 11 and 12.

Fluid containment means are associated with the shell in heat transfer relation therewith, with one form thereof being the fluid conduit means shown in FIGS. 1 to 3. The fluid conduit means is in the form of generally square tubing 30 which is close-wound in a spiral configuration and which is commercially available. A suitable length of this conduit means is slipped onto the exterior of the shell 10 and, if desired, a heat transfer promoting medium may be placed between the conduit means and the shell, such as a grease with aluminum oxides or a silicone which are commercially available. Opposite ends of the spirally-wound length of conduit means each have a fitting associated therewith, such as fittings 31 and 32 to connect to a fluid line.

Although not shown, the efficiency of the unit can be further improved by applying insulation to the exterior of the fluid conduit means and shell which is simply done because of the generally cylindrical shape of the unit.

With the disclosed construction, a simple unit is provided which uses simple components, such as commercially-available pipe or tubing and commercially-available pre-wound tubing to provide fluid conduit means. This structure is energy-saving in saving of manufacturing energy because of the simple basic nature of the components.

The costs of the unit are small, both in initial cost for materials used as well as in operating costs because of low pressure losses through the unit and with high heat exchange efficiency because of basically a counterflow action with the capability of constant temperature within the shell.

In use of the unit as a chiller, the fluid delivered through the fluid port 25 to the upper compartment 26 would be liquid ammonia and helium. This fluid is then caused to flow downwardly along the entire length of the shell and along the interior of the shell wall by flowing through the perforations 27 at the opposite edges of the partition member 20. The liquid ammonia changes state in the lower compartment to ammonium vapor, with this vapor and helium gas being free to pass out through the enclosure 12 and tubular member 15. At the same time, warmer helium gas is entering the lower compartment through the end closure 11. This process results in a substantially constant temperature within the shell and along the entire length thereof because of the uniform flow along the entire length of the shell of fluid from the upper compartment. The heat transfer through the shell causes reduction in temperature in a fluid, such as ethylene glycol/water solution, carried in the fluid conduit means 30 which may be used as part of an air conditioning system, such as described in my previously-mentioned U.S. Pat. No. 3,661,200. In order to obtain complete vaporization of the liquid ammonia within the shell, the opposite ends thereof have liquid dams, provided by an annular section of the end closures 11 and 12. These liquid dams retain ammonia in the liquid condition until vaporization thereof occurs. In use as a chiller, two fluids within the shell can actually pass in opposite directions, while a third fluid is travelling in the fluid conduit means 30 which surrounds the shell.

The embodiment of FIGS. 1 to 3 shows a spirally-wound rectangular tubing usable as the exterior fluid conduit. It is also possible to use spirally close-wound round tubing. Additional structures are available for this purpose. FIG. 4 shows a commercially available formed plate 50 having fluid conduit lengths 51 and which comes in sheet form and which may be shaped around the shell 10. Additional structures are available, such as a formed plate having a fluid conduit forming a sinuous path for flow of fluid or pairs of semi-cylindrical lengths of spirally-wound tubing which can be fitted about the shell and interconnected to obtain a fluid flow path about the shell, generally similar to that shown in FIG. 1.

The heat exchanger disclosed is of utmost simplicity in having a shell formable from commercially available pipe or tubing and with fluid conduit means disposed therearound in good heat exchange relation, with the fluid conduit means being commercially available and with the structure being capable of simple insulation for even greater efficiency of operation.

An additional use of the heat exchanger is as a condenser wherein the unit would be rotated 180° from the orientation shown in FIG. 3. A cool fluid would pass through the fluid containment means and a vapor entering into the shell from an end thereof would condense and flow out from fluid port 25.

The use of the heat exchanger in a typical air conditioning application is shown in FIG. 5. Several of the heat exchange units H are arranged in a vertical row in horizontal positions and with units positioned one directly above another in the row. The vertical space between units in a row is approximately one-half the diameter of a shell 10. Liquid refrigerant is introduced into the upper compartment of each horizontal unit through a pipe 60 connected to the ports 25. The refrigerant flows horizontally the length of the shell upper compartments and flows down the interior of the shell walls into the lower compartments, as earlier described for the chiller application. The refrigerant is evaporated from the entire length of the lower compartment by exchange of heat through the shell wall from a warmer fluid, such as air flowing normal to the longitudinal axes of the horizontally-disposed heat exchanger units, as indicated by arrows A. This flow is through a formed contained fluid path, such as a duct 61, the boundaries of which are side walls 62 and 63 adjacent the ends of the horizontal lengths of the heat exchanger units and the top wall 64 and bottom wall 65 spanning a vertical distance from the bottom of the lowermost heat exchange unit to the top of the uppermost unit. The vaporized refrigerant leaves the heat exchange units through tubular members 15, with the tubular members 14 being closed. Because of the higher efficiency of the heat exchange units disclosed herein, it is possible to use a minimal number of vertical rows of units for a typical air conditioning application in which the refrigerant is evaporated within the lower compartments of the shells by exchange of heat from the warmer fluid (air) flowing normal to the longitudinal axes of the heat exchange units H.

I claim:

1. A heat exchanger comprising, a horizontally-disposed elongate shell, a partition within and extending lengthwise of said shell to form upper and lower compartments within the shell, end closures for said shell with at least one end closure having a flow passage communicating with one of the compartments of said shell, a fluid port communicating with the other of said compartments, means providing for gravity fluid flow from the upper compartment into said lower compartment by flow onto the interior surface of the shell along the length thereof, and fluid containment means substantially enclosing the exterior of the shell for substantially the entire length of the shell to place fluid in the fluid containment means in heat exchange relation with said shell wall.

2. A heat exchanger as defined in claim 1 wherein both of said end closures have a flow passage for flow of fluid therethrough.

3. A heat exchanger as defined in claim 1 wherein each end of said shell has a liquid-restraining dam.

4. A heat exchanger as defined in claim 1 wherein said fluid containment means is formed as a series of connecting fluid passages with each of the passages at least partially wrapped about said shell.

5. A heat exchanger as defined in claim 1 wherein the fluid port communicates with the upper compartment and said fluid flow providing means comprises a series of openings along each longitudinal edge of said partition where said edges meet said shell to have the fluid flow wet the interior of said shell wall.

6. A heat exchanger as defined in claim 5 usable as a chiller wherein said fluid port is connectable to a source of liquid vaporizable refrigerant and said fluid containment means includes a liquid to be chilled.

7. A heat exchanger as defined in claim 5 and usable as a chiller wherein both of said end closures have flow passages to permit flow of gases including vaporized refrigerant therethrough.

8. A heat exchanger as defined in claim 1 wherein said fluid containment means is a fluid conduit defined by a continuous length of spirally close-wound tubing in close-fitting relation with said shell.

9. A heat exchanger as defined in claim 1 wherein said fluid containment means is defined by preformed panels in close fitting relation with said shell and having a continuous fluid passage formed therein.

10. A heat exchanger as defined in claim 1 wherein said shell is a cylindrical tube of a predetermined diameter and said partition is defined by an arcuate longitudinal section of a cylindrical tube of a greater diameter.

11. A heat exchanger as defined in claim 10 wherein the opposite edges of said partition section engage the interior of the shell and said fluid flow providing means includes a series of recesses along each edge of said partition section.

12. A heat exchanger comprising, a tubular elongate shell of a predetermined diameter, a transversely curved elongate partition member fitted in said shell to divide the shell into upper and lower compartments extending lengthwise of the shell, said partition member being upwardly convex, end closures for said shell each having a flow passage communicating with the lower compartment of the shell, said shell having a fluid port communicating with the upper compartment, two series of through passages formed in said partition member and extending lengthwise thereof with said series being closely adjacent to the junctures of the partition member with said shell, and fluid conduit means substantially enclosing said shell and closely fitted thereto for good heat transfer and providing for a sinuous flow of fluid from end to end of the shell to maximize the heat transfer between said shell and the last-mentioned fluid.

13. A heat exchanger comprising, an elongate generally cylindrical shell, a curved partition member within and extending lengthwise of said shell and with opposite edges contacting the shell interior to divide the shell into first and second compartments and with the second compartment having a major part of the volume within the shell, end closures for said shell with at least one end closure having a tubular flow passage communicating with said shell second compartment and of a cross-sectional area closely approximating that of said second compartment, a fluid port communicating with the first of said compartments, a series of flow passages along each edge of said partition member for controlling fluid flow between said compartments and causing fluid flow along the curved interior surface of said shell, and fluid conduit means wrapped around and substantially enclosing the exterior of said shell in a manner to have a generally cylindrical exterior configuration and operative to place fluid within the fluid conduit means in heat exchange relation with the shell.

14. A heat exchanger as defined in claim 13 and usable as a chiller wherein said second compartment having a major part of the cross-sectional area within the shell is beneath said first compartment and wherein both of said end closures have a tubular flow passage with a cross-sectional area closely approximating that of said lower compartment.

* * * * *